US005492303A

United States Patent [19]

Jaruzel

[11] Patent Number: 5,492,303

[45] Date of Patent: Feb. 20, 1996

[54] FORMWORK FOR SURFACES VARYING IN CURVATURE

[75] Inventor: Kurt Jaruzel, Haslach, Germany

[73] Assignee: Paschal-Werk G. Maier GmbH, Steinach, Germany

[21] Appl. No.: 142,344

[22] PCT Filed: May 14, 1992

[86] PCT No.: PCT/DE92/00389

§ 371 Date: Nov. 18, 1993

§ 102(e) Date: Nov. 18, 1993

[87] PCT Pub. No.: WO92/20887

PCT Pub. Date: Nov. 26, 1992

[30] Foreign Application Priority Data

May 18, 1991 [DE] Germany ..... 41 16 439.3

[51] Int. Cl.[6] ..... E04G 11/00

[52] U.S. Cl. ..... 249/4; 249/1; 249/18; 249/40; 249/154; 249/155; 249/182; 249/189; 249/191; 249/210; 249/219.1

[58] Field of Search ..... 249/18, 33, 40, 249/44, 48, 1, 4, 154, 155, 181, 182, 189, 191, 209, 210, 219.1, 219.2

[56] References Cited

U.S. PATENT DOCUMENTS

| | | | |
|---|---|---|---|
| 2,616,148 | 11/1952 | Hawes | 249/18 |
| 3,659,978 | 5/1972 | Svensson | 249/48 |
| 3,767,158 | 10/1973 | Mikus | 249/40 |
| 4,433,826 | 2/1984 | Schimmel | 249/191 |
| 4,520,989 | 6/1985 | Digh | 249/48 |
| 4,553,729 | 11/1985 | Connors | 249/40 |
| 4,619,433 | 10/1986 | Maier | 249/18 |
| 4,729,541 | 3/1988 | Maier | 249/194 |
| 4,917,346 | 4/1990 | Mathis | 249/44 |
| 5,125,618 | 6/1992 | Saervoll | 249/44 |

FOREIGN PATENT DOCUMENTS

| | | | |
|---|---|---|---|
| 484080 | 5/1992 | European Pat. Off. | 249/40 |
| 147770 | 6/1990 | Japan | 249/48 |

*Primary Examiner*—Jay H. Woo
*Assistant Examiner*—Vi Duong Dang
*Attorney, Agent, or Firm*—Darby & Darby

[57] ABSTRACT

Formwork for surfaces varying in curvature has a face sheet adjustable with respect to its curvature, girders supporting the face sheet and applied to the girders, in spaced relationship to the face sheet, there is a boom system which is composed of individual boom members bridging the girders and is suitably attached to the girders at the outsides thereof averted from the face sheet. Adjustment of the curvature of the face sheet is carried out by altering the effective length of the boom members between the girders. The mutually opposed formwork elements are adapted to be braced together by means of formwork anchor ties. A crosspiece in the form of a boom member is applied to a formwork element at at least two girders and simultaneously serves as an abutment for the formwork anchor tie, the latter therefore being arranged between and having its reaction forces transferred to the two girders. The crosspiece is likewise changeable in its effective length by its fastening location being adjustable in the longitudinal direction in which the crosspiece extends and transversely to the orientation of the girder, so that the crosspiece is available as an adjustable boom member in altering the curvature of the face sheet, as well as sustaining the tension forces.

15 Claims, 3 Drawing Sheets

FORMWORK FOR SURFACES VARYING IN CURVATURE

BACKGROUND OF THE INVENTION

The invention relates to formwork for surfaces varying in curvature, including a face sheet adjustable with respect to its curvature, including girders supporting the face sheet and further including a boom system composed of individual boom members applied to the girders in spaced relationship to the face sheet, the effective length of the boom members between the girders and their points of application being adjustable at the girders to change the curvature of the face sheet, and mutually opposed formwork elements being adapted to be braced by means of formwork anchor ties.

Such formwork is known from German Patent Specification No. 24 26 708. In that reference, the boom members are formed by oppositely threaded tie rods engaging with a threaded sleeve on either side, so-called turnbuckles, rotation of the sleeve bringing about the desired change in length. On account of the distance of the boom members from the face sheet, the curvature of the face sheet can be changed through such a change in length. In each case one end of the rod engages a girder and it is necessary for the mutually opposed girders of the formwork elements to be braced together by means of formwork anchor ties in order that the distances of the mutually opposed formwork elements are maintained, particularly when the concrete is being poured in. This formwork has proved successful, but requires a relatively large number of formwork anchor ties because these are present on each girder.

Formwork having a face sheet changeable with respect to its curvature is already known from European Patent Specification No. 0 139 820, in which no formwork anchor ties whatsoever are provided for the mutually opposed formwork elements. This signifies, however, that the formwork elements of the mutually opposed surfaces are completely separate from each other, so that the slightest inaccuracies during erection lead to deviations in the thickness of the wall to be concreted. In addition, during the process of concrete placement there is the danger that—through the concrete often poured in suddenly and quickly—formwork walls, which may initially have been accurately in position, become misaligned or moved. This likewise results in inaccuracies to the finished concrete wall.

SUMMARY OF THE INVENTION

The object underlying the invention is therefore to provide formwork of the kind mentioned at the outset, which needs fewer formwork anchor ties but wherein provision is nevertheless made for the mutually opposed formwork elements to be braced together.

This object is accomplished in that a crosspiece in the form of a boom member is applied to a formwork element at at least two girders and is simultaneously provided as an abutment for the formwork anchor tie, the crosspiece being adapted to be adjusted and located in position at at least one of the girders it acts upon, adjustment being effected in the longitudinal direction in which the crosspiece extends and transversely to the orientation of the girder.

In this manner, crosspieces my serve to adjust the distance of the girders and thereby to change the curvature and also simultaneously serve as an abutment for a formwork anchor tie between two girders, halving the number of formwork anchor ties as compared with a solution having tie points at each girder. Nevertheless, the reaction forces of the formwork anchor tie can be introduced into the two girders adjacent thereto by way of the crosspiece. In an advantageous way the design of a boom portion or boom member as a crosspiece capable of transferring forces arising transversely to the path it takes can hence give the boom member a dual function.

It is suitable if the abutment location for the formwork anchor tie is arranged on the crosspiece between the locations at which the crosspiece is fastened to two adjacent girders and the crosspiece rests against and preferably laps over the girders particularly at the sides thereof averted from the formwork. The crosspiece hence bridges two girders and can transfer the tension forces emanating from the formwork anchor tie to the back of the two girders approximately evenly.

The crosspiece may be provided with an adjusting spindle with which a relative movement between the crosspiece and the girder the crosspiece acts upon can be performed by means of a nut which is fastened particularly in a detachable manner to the girder and co-operates with the spindle. This represents a particularly simple possibility of relative lengthwise adjustment between two girders at the crosspiece, without the crosspiece itself having to be of telescopic-like design. The respective effective length of the crosspiece and its projecting length relative to the girder is altered merely with the aid of the adjusting spindle.

For an effective transfer of the transverse forces from the crosspiece to the girder in the area of the adjusting spindle, it is suitable if a guideway provided on the crosspiece is an elongated hole which is arranged in the longitudinal direction in which the crosspiece extends so as to be parallel to the spindle at least in the working area thereof.

Arranged on the girder there may be a guide bolt or the like which traverses the elongated hole and on the one hand is connectable—preferably detachably—to the girder, particularly by way of a strap, flange or the like, and on the other hand carries the nut for the adjusting spindle anchored to the crosspiece. Hence, through rotation of the adjusting spindle arranged parallel to the crosspiece, the adjusting spindle itself together with the crosspiece can be adjusted relative to the nut in the longitudinal direction, through which the bolt carrying the nut is moved within the elongated hole, so that thereby the respective effective length of the crosspiece is changed at the girder. This nevertheless leads to very easy handling and in addition is capable of transferring the forces encountered well.

It is particularly advantageous if the formwork element has an even number of more than two girders, particularly parallel ones, and in each case one girder directly adjacent to the edge of the formwork element is connected, via the crosspiece, to the second girder which is in turn adjacent to the first one, and if the pairs of girders thus formed are interconnected by way of a turnbuckle adjustable in its length as a further boom member. Therefore on a formwork element crosspieces alternate with a turnbuckle, no formwork anchor tie being required at the turnbuckle because such can be supported at the cross-pieces joined to the turnbuckle.

A formwork element which handles well with respect to its size ensues if it is provided with four approximately parallel girders and the two girders in each case near the edge are bridged and connected by crosspieces and if the girders adjacent to each other in the centre area of the formwork element are connected by a turnbuckle continuing the boom system. Such a formwork element with four girders hence has a boom system with two crosspieces and a turnbuckle continuing the crosspieces and requires only two formwork anchor ties instead of double as many of them engaging all four girders.

For connecting the crosspieces to the girders it is advantageous if the crosspieces are applied, via Joints, to abutment members connectable to the girders, particularly detachably, so that the boom system can also be removed again.

Suitably, the turnbuckles arranged in each case between two crosspieces belonging to a boom system are jointed to the confronting ends of the crosspieces, so that the turnbuckles and the crosspieces form a virtually continuous chain of booms which, by virtue of the Jointed mountings, also allows adaptation to different curvatures of the face sheet.

If the crosspieces have a projecting length relative to the girders they connect, the turnbuckle my be jointed to the confronting projecting ends of two crosspieces. In this way, sufficient room for this joint and at the same time a firm support of a crosspiece at two girders is produced.

A measure allowing spindles of the smallest possible size to be used, resides in that the spindle are subjected to a tensile force when the curvature is altered for a smaller radius of curvature and therefore the spindles have to be designed essentially only for sustaining such tensile forces.

Formwork for curved surfaces—permitting formwork elements to be accurately braced together, without a formwork anchor tie having to be applied to each formwork girder, and wherein nevertheless the curvature is adjustable virtually at will so that curved walls can be concreted very accurately— results particularly from the features and measures described herein being used singly or severally.

BRIEF DESCRIPTION OF THE DRAWINGS

An exemplified embodiment of the invention is described in further detail below with reference to the drawings in which, partly in schematic form.

DETAILED DESCRIPTION

Figure 1:
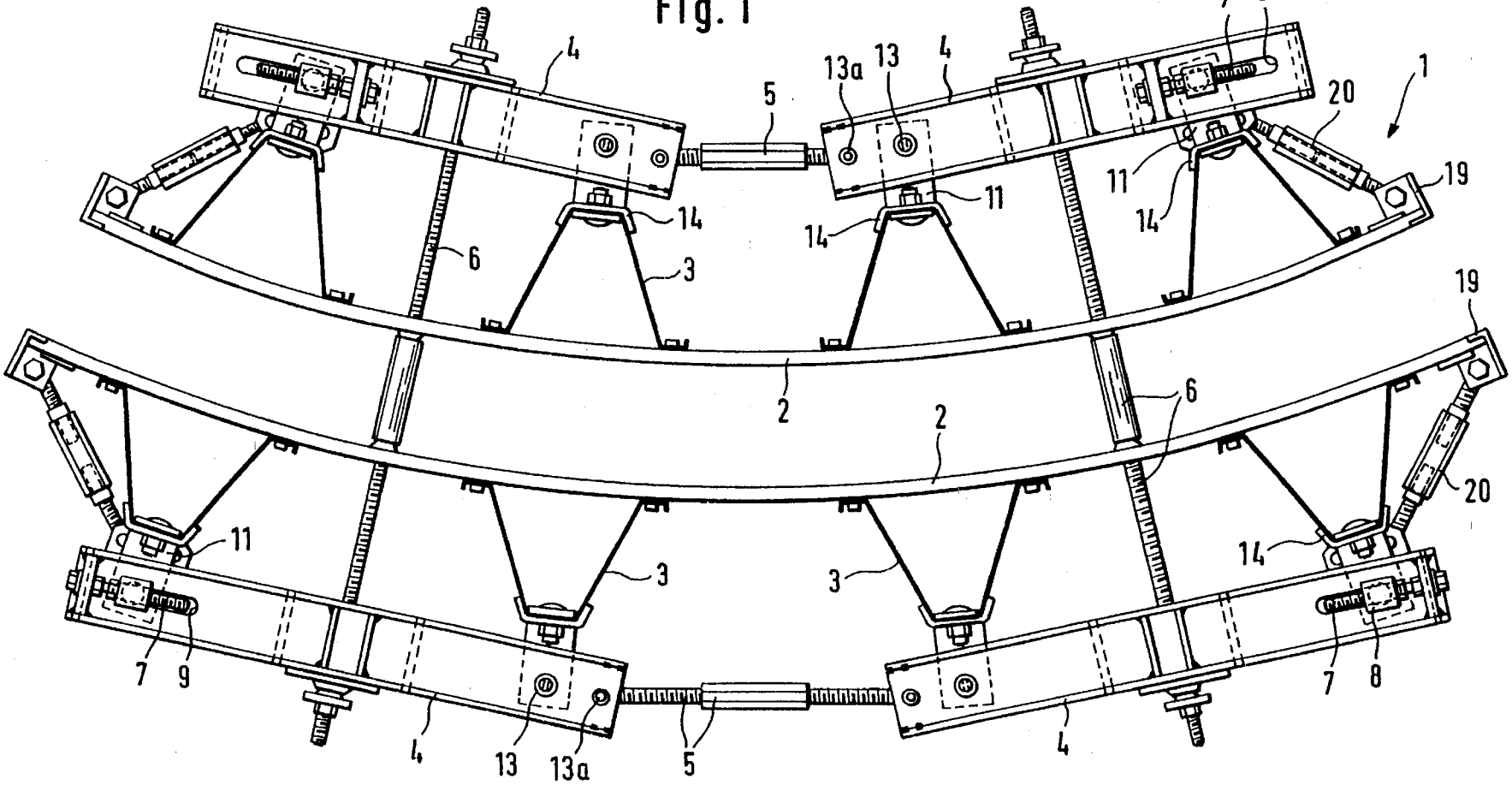
FIG. 1 is a plan view of curved formwork with two mutually opposed formwork elements braced together, the face sheets thereof being in curvilinear, parallel relationship.

Formwork, designated altogether 1, permits adaptation to surfaces of varying curvature and accordingly has a face sheet 2 adjustable with respect to its curvature. The face sheet 2 is supported and stiffened by girders 3 of trapezoidal cross section and applied to the girders 3, in spaced relationship to the face sheet 2, there is at least one boom system or chain of booms composed of individual boom members 4 and 5, possibly a plurality thereof staggered over the height. The effective length of the boom members 4 and 5 between the girders 3 is adjustable, so that thereby the curvature of the face sheet 2 can be set. It is apparent from FIG. 1 that the mutually opposed formwork elements consisting of face sheet 2 and girders 3 are adapted to be braced together by means of formwork anchor ties 6.

It becomes clear particularly in the light of FIG. 1 that a crosspiece in the form of boom member 4, accordingly referred to in the following as "crosspiece 4" is applied to a formwork element at two girders 3 and simultaneously serves as an abutment for a formwork anchor tie 6 arranged between two girders 3. The crosspiece 4 is adapted to be adjusted and located in position at at least one of the girders 3 it acts upon, adjustment being effected in the longitudinal direction in which the crosspiece extends and transversely to the orientation of the girder 3, so that the girders are drawn together or moved apart with their outsides averted from the face sheet 2 and thereby the curvature of the face sheet 2 can be changed.

Figure 3:
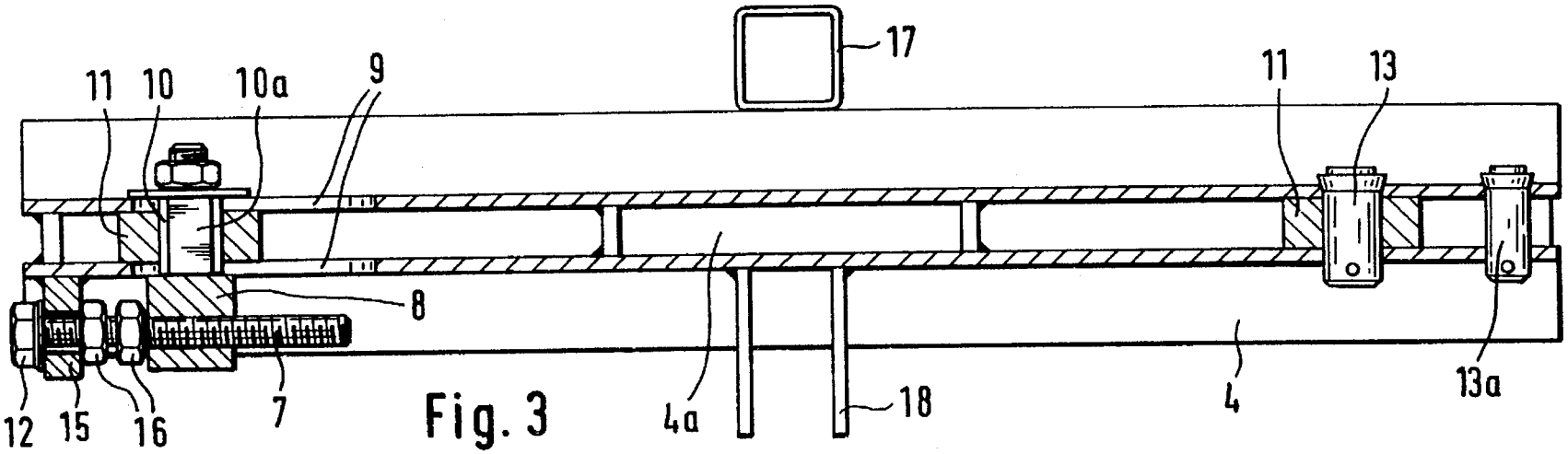
Figure 5:
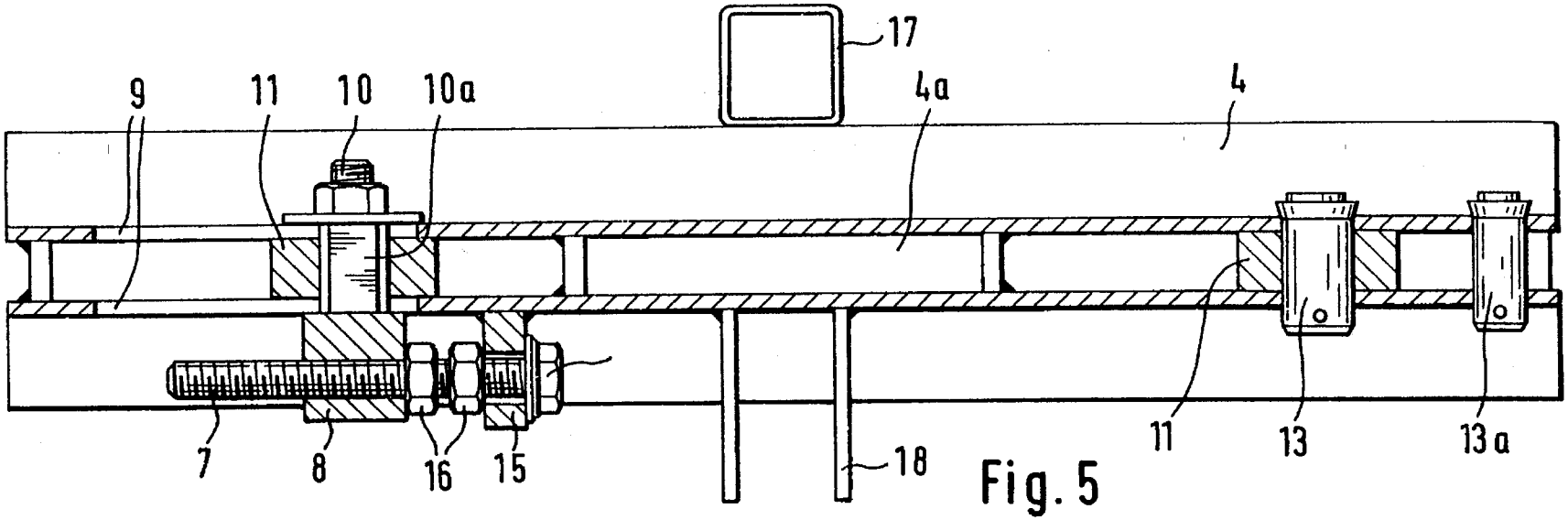

The abutment location for the formwork anchor tie 6 is arranged on the crosspiece between the locations at which the crosspiece is fastened to two adjacent girders 3, particularly approximately medially therebetween, and in the embodiment of FIGS. 3 and 5 takes the form of a longitudinal slot 4*a*. Therefore, changing the effective length of the crosspiece and the distance of the outsides of the girders 3 does not affect the position of the formwork anchor tie 6, or conversely the adjustment at the crosspiece 4 is not impeded by the formwork anchor tie 6. Hence, even when the crosspiece 4 varies in effective length, the reaction forces of the formwork anchor tie 6 are introduced virtually evenly and with approximately equal magnitude into the girders 3 adjacent thereto.

According to FIGS. 2 to 5, the crosspiece 4 is provided with an adjusting spindle 7 with which a relative movement between the crosspiece 4 and the girder 3 the latter acts upon can be performed by means of a nut 8 which is fastened particularly in a detachable manner to the girder 3 and co-operates with the spindle 7. A guideway in the form of an elongated hole 9 is provided on the crosspiece 4 and runs in the longitudinal direction in which the crosspiece 4 extends so as to be parallel to the spindle 7 at least in the working area thereof. Arranged on the girder 3 is a guide bolt 10 which traverses the elongated hole 9 and on the one hand is connected to the girder 3 by way of a strap 11 or a flange and on the other hand carries the nut 8 for the adjusting spindle 7 anchored to the crosspiece 4. If now the adjusting spindle 7 is turned by way of its hexagon 12, this also brings about an axial adjustment of the adjusting spindle 7 relative to its nut 8, altering the distance between the guide bolt 10 and a retaining bolt 13 fastened to the parallel girder 3 and thereby the effective length of the crosspiece 4.

Thus the outsides of the girders 3 are moved together or apart, resulting in a change in the curvature of the face sheet 2.

In the exemplified embodiment, the two formwork elements to be seen in FIG. 1 in each case have an even number of more than two, namely four parallel girders 3 and in each case two girders 3 directly adjacent to the edge of a formwork element are connected and bridged by crosspieces 4, while the pairs of girders thus formed are interconnected by way of a turnbuckle adjustable in its length as a further boom member 5. Therefore the distance of the two girders 3 situated at the confronting ends of the crosspieces 4 can also be altered, so that the entire curvature of the face sheet 2 can be adjusted largely evenly.

In order to be able to carry out this change in curvature without resistance at the boom system, the crosspieces 4 are applied, via joints, to abutment members to which the straps 11 belong, the latter being traversed by bolts 10 and 13. These abutment members 14 are for their part detachably connectable to the girders 3, so that the boom system can also be removed.

The turnbuckles 5 arranged in each case between two crosspieces 4 belonging to a boom system are for their part jointed at 13*a* to the confronting ends of the crosspieces 4, so that the chain of booms is closed and is adaptable well to the curvature. The crosspieces 4 arranged at the outside of the girders 3 have a projecting length relative to the girders 3 they connect and the turnbuckle 5 is jointed to the confronting projecting ends of two crosspieces 4.

Figure 2:
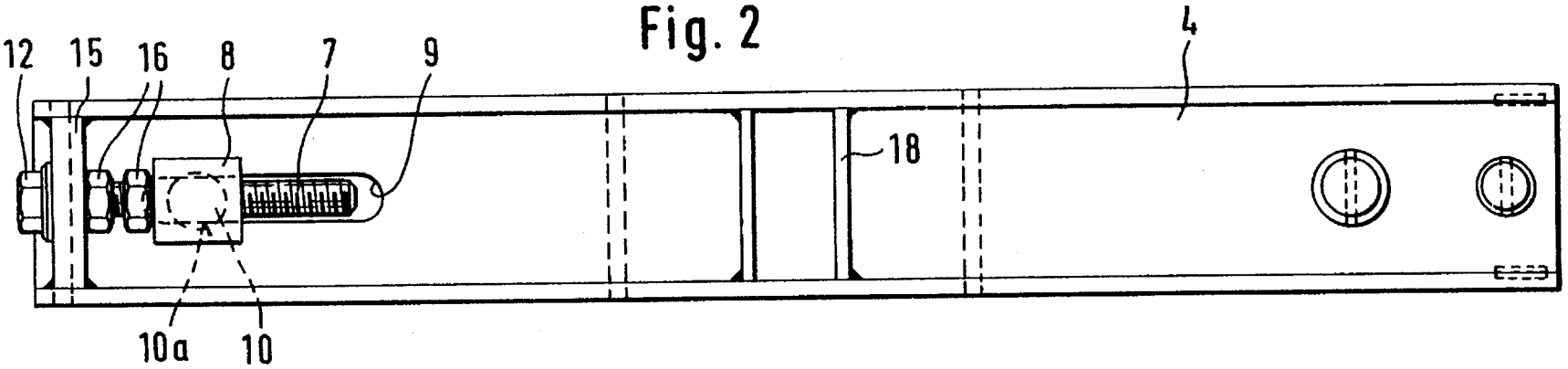
FIG. 2 is a plan view and FIG. 3 is a longitudinal section of a crosspiece to be arranged at the outer curvature of the formwork, including the anchoring means for joining to the formwork element and an adjusting spindle which is applied thereto and is directed from the end towards the centre.
Figure 4:
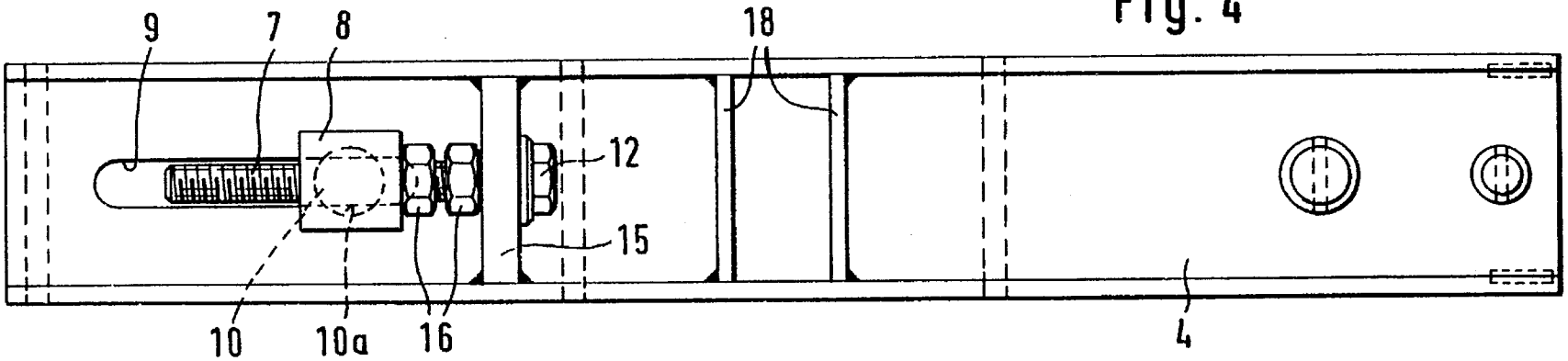
FIG. 4 is a plan view and FIG. 5 is a longitudinal section of a crosspiece for fitting to the inner curvature of the formwork of FIG. 1, the adjusting spindle with the free end thereof being directed towards the end of the crosspiece and the anchorage of the spindle being arranged in spaced relationship to that end.

It is to be seen particularly in FIGS. 2 and 3 as well as FIGS. 4 and 5, that the adjusting spindle 7 at the crosspiece 4 is arranged parallel to the elongated hole 9 and with one end is mounted to a holding web 15 of the crosspiece 4 so as to be rotatable but fixed in the axial direction and engages with the block which is carried by the guide bolt 10 and forms the spindle nut 8, so that when the spindle 7 turns the block is shifted relative to and in the direction of the elongated hole 9.

The adjusting spindle 7 also carries lock nuts 16 lockable relative to the adjusting nut 8 and/or the web 15, so that the respective set position can be fixed in such a way that vibrating of the concrete or other dynamic loads does not lead to an unintentional misplacement of the envisaged curvature of the face sheet 2.

In the light of FIG. 1 as well as in the light of FIGS. 2 and 3 on the one hand and FIGS. 4 and 5 on the other hand, it is to be seen that different crosspieces 4 are provided, depending on whether they are designated for arrangement at the inside of a curvature of the formwork 1 or at the outside. In the case of a crosspiece 4 for arrangement at the inside of a curvature, the adjusting spindle 7 according to FIGS. 4 and 5 is directed with its free end towards that end of the crosspiece 4 which points to the edge of the formwork element. In the case of a crosspiece 4 for the outside of a curvature of the formwork, the spindle 7 according to FIGS. 2 and 3 is mounted at the end of the crosspiece 4 and points with its free end towards the centre of the crosspiece 4. By this means it is achieved that these spindles 7 are subjected only to tensile stress by the curvature being set and by the reaction forces resulting from the curvature and they therefore have to be less amply dimensioned than if they also had to sustain compressive forces.

FIGS. 3 and 5 show that the crosspieces 4 may have coupling points or bearings 17 and 18 e.g. for platform brackets and ground supports, through which an additional function can be assigned to the crosspieces. Since the crosspieces 4 are themselves very flexurally stiff on account of their double T-shaped profiling with an inner double web and are very firmly anchored through the formwork anchor ties on the one hand and through the fixation to the girders 3 on the other hand, they can also transfer corresponding additional supporting and retention forces. Hence the crosspieces can serve to change the effective length of a boom portion between two girders 3, as well as to sustain the tension forces of the formwork anchor ties, as well as finally also to hold platform brackets or ground supports.

FIG. 1 also shows that in each case in the edge area of a formwork element a turnbuckle 20 or like element is provided which is directed from the girder 3 at the outside thereof averted from the face sheet 2 and/or from the holding device for the crosspiece 4 towards the adjacent formwork edge 19 and is jointed thereto, the turnbuckle or like element serving to set the round form or curvature of the edge area of the face sheet 2 next to a girder 3. These turnbuckles 20 serving to set the round form of the edge of the face sheet 2 may be vertically offset relative to the crosspieces4 in the longitudinal direction of the girders 3.

The formwork 1 for surfaces varying in curvature has a face sheet 2 adjustable with respect to its curvature, girders 3 supporting the face sheet and applied to the girders 3, in spaced relationship to the face sheet 2, there is a boom system which is composed of individual boom members 4 and 5 bridging the girders 3 and is suitably attached to the girders 3 at the outsides thereof averted from the face sheet 2. Adjustment of the curvature of the face sheet 2 is carried out by altering the effective length of the boom members 4 and 5 between the girders 3. The mutually opposed formwork elements are adapted to be braced together by means of formwork anchor ties 6. A crosspiece 4 in the form of a boom member is applied to a formwork element at at least two girders and simultaneously serves as an abutment for the formwork anchor tie 6, the latter therefore being arranged between and having its reaction forces transferred to two girders. The crosspiece is likewise changeable in its effective length by its fastening location being adjustable in the longitudinal direction in which the crosspiece extends and transversely to the orientation of the girder, so that the crosspiece 4 is available both as an adjustable boom member in altering the curvature of the face sheet 2, as well as sustaining the tension forces.

It is also apparent from FIGS. 2 and 3 on the one hand and FIGS. 4 and 5 on the other hand that the guide bolt 10 is provided on either side in the area of an otherwise round portion with a surface or flattening 10*a* resting against the edges of the respective elongated hole 9. By this means, the forces are introduced from the boom members 4 into the girders 3 via the surfaces or edges of the elongated hole 9 to the surface or flattening 10*a* of the guide bolt 10 and from the latter, in turn, via the round form of the guide bolt 10 into the hole of the strap 11. Thereby line or point contact and corresponding overloading are avoided.

I claim:

1. Formwork for surfaces varying in curvature, including a face sheet adjustable with respect to the curvature thereof, including girders supporting said face sheet and further including a boom system composed of individual boom members applied to the girders in spaced relationship to the face sheet, the effective length of the boom members between the girders and their points of application being adjustable at the girders to change the curvature of the face sheet (2), and mutually opposed formwork elements being adapted to be braced by means of formwork anchor ties, wherein a crosspiece in the form of a boom system member is applied to a formwork element at at least two girders and is simultaneously provided as an abutment for the formwork anchor tie, said crosspiece being adapted to be adjusted and located in position at at least one of the girders upon which said crosspiece acts, adjustment being effected in the longitudinal direction in which said crosspiece extends and transversely to the orientation of the girder, wherein the crosspiece is provided with an adjusting spindle with which a relative movement between the crosspiece and the girder upon which the crosspiece acts can be performed by means of a nut which is detachably fastened to the girder and cooperates with the spindle.

2. Formwork as claimed in claim 1, wherein the abutment location for the formwork anchor tie is arranged on the crosspiece between the locations at which said crosspiece is fastened to two adjacent girders, particularly approximately medially therebetween and takes the form of a longitudinal slot.

3. Formwork as claimed in claim 1, wherein a guideway provided on the crosspiece is an elongated hole which is arranged in the longitudinal direction in which the crosspiece extends so as to be approximately parallel to the spindle at least in the working area thereof.

4. Formwork as claimed in claim 3, wherein arranged on the girder is a guide bolt which traverses the elongated hole and on the one hand is connectable to the girder, particularly by way of a strap or flange, and on the other hand carries the nut for the adjusting spindle anchored to the crosspiece.

5. Formwork as claimed in claim 1, wherein the formwork element has an even number of more than two particularly parallel girders, and in each case one girder directly adjacent to the edge of the formwork element is connected, via the crosspiece, to the second girder which is in turn adjacent to the first one, and the pairs of girders thus formed are interconnected by way of a turnbuckle adjustable in its length as a further boom member.

6. Formwork as claimed in claim 1, wherein a formwork element is provided with four approximately parallel girders and the two girders in each case near the edge are bridged and connected by crosspieces and the girders adjacent to each other in the centre area of the formwork element are connected by a turnbuckle continuing the boom system.

7. Formwork as claimed in claim 1, wherein the crosspieces are applied, via joints, to abutment members connectable to the girders, particularly detachably.

8. Formwork as claimed in claim 5, wherein the turnbuckles arranged in each case between two crosspieces belonging to a boom system are jointed to the confronting ends of the crosspieces.

9. Formwork as claimed in claim 4, wherein the guide bolt is provided on either side with a surface or flattening resting against the edges of the elongated hole.

10. Formwork as claimed in claim 4, wherein the adjusting spindle at the crosspiece is arranged parallel to the elongated hole and with one end is mounted to a holding web of the crosspiece so as to be rotatable and engages with a block which is carried by the guide bolt and forms the spindle nut.

11. Formwork as claimed in claim 10, wherein the adjusting spindle carries a lock nut, particularly one lockable relative to the spindle nut.

12. Formwork as claimed in claim 1, wherein in the case of a crosspiece for arrangement at the inside of a curvature of the formwork, the adjusting spindle is directed with its free end towards the end of the crosspiece which points to the edge of the formwork element, and that in the case of a crosspiece for the outside of a curvature of the formwork, the spindle is mounted at the end of the crosspiece and points with its free end towards the centre of the crosspiece.

13. Formwork as claimed in claim 1, wherein the crosspieces have coupling points or bearings for either or both platform brackets and ground supports.

14. Formwork as claimed in claim 1, wherein in the edge area of a formwork element a turnbuckle is provided which is directed from the girder at the outside thereof averted from either or both the face sheet and the holding device for the crosspiece towards the adjacent formwork edge and is jointed thereto, said turnbuckle serving to set the round form of the edge area of the face sheet next to a girder.

15. Formwork as claimed in claim 14, wherein the turnbuckles serving to set the round form of the edge of the face sheet are offset relative to the crosspieces in the longitudinal direction of the girders.

* * * * *